United States Patent [19]

List et al.

[11] Patent Number: 4,824,257

[45] Date of Patent: Apr. 25, 1989

[54] KNEADER-MIXER

[75] Inventors: Heinz List; Jörg List, both of Pratteln, Switzerland

[73] Assignee: List AG, Pratteln, Switzerland

[21] Appl. No.: 145,835

[22] Filed: Jan. 20, 1988

[30] Foreign Application Priority Data

May 6, 1987 [CH] Switzerland ..... 1726/87

[51] Int. Cl.[4] ..... B01F 7/04

[52] U.S. Cl. ..... 366/99; 366/149; 366/307; 366/313; 366/317

[58] Field of Search ..... 366/65–67, 366/96, 97, 144, 149, 279, 75, 292, 293, 302–307, 309, 99, 312, 313, 315, 317, 325; 422/225

[56] References Cited

U.S. PATENT DOCUMENTS

| | | | |
|---|---|---|---|
| 1,525,681 | 2/1925 | Engel, Jr. | 366/307 |
| 2,204,029 | 6/1940 | Russell | 366/305 |
| 2,891,777 | 6/1959 | Gregorius | 366/303 X |
| 4,650,338 | 3/1989 | List et al. | 366/97 |
| 4,701,054 | 10/1987 | Cipelletti | 366/312 |

*Primary Examiner*—Timothy F. Simone

*Attorney, Agent, or Firm*—Helfgott & Karas

[57] ABSTRACT

Kneader-mixers for mechanical and thermal treatment of products in different state forms, comprising a heatable cylindrical casing and a kneader shaft with heatable disk elements revolving therein and on which are arranged kneading blades scraping the inner wall of the casing. During mixing, these stirring elements cooperate with the hook-like kneading counterelments cleaning the stirrer surfaces and fixed in the casing. In each counterelement an arm forms a kneading gap with the casing wall, while second and third arms clean the disks and shaft. Each radial scraper for each disk element has at least two separate scraping edges, which subdivide the product into two product flows and through the inclined position of the kneading counterelements the scraped product acquires a powerful axial and radial transport component.

12 Claims, 6 Drawing Sheets

KNEADER-MIXER

BACKGROUND OF THE INVENTION

The invention relates to kneader mixers, and more particularly to kneader-mixers for the mechanical and thermal treatment of products in a liquid, pasty and/or pulverulent state.

One type of such kneader-mixer, described in Swiss Pat. No. 583061, contains a heatable cylindrical casing and a stirrer shaft coaxially rotating therein with disk elements which are rectangularly mounted on the shaft and which cooperate with hook-like kneading counterelements are arranged within longitudinal sectional planes passing through the casing axis. In this arrangement, the open vicinity of the hook-like kneading counterelements. Practice has shown that in the case of certain structurally viscous products, e.g. cellulose derivatives or alkaline alkoxides, material builds up on the counterhooks. This can lead to the formation of toroidal structures which greatly constrict a large part of the machine required for conveying and discharging the product and the gases which may form. Another disadvantage of this construction and arrangement is that the scraping edges of the hook-like kneading counterelements are directly and simultaneously stressed vertically thereby requiring a high force expenditure leading to rapid wear of the scraping edges and reduced efficiency in the removal of crusts from the heated surfaces.

The object of the present invention is to overcome or substantially reduce the above mentioned disadvantages inherent in such known kneader-mixer constructions and arrangements.

SUMMARY OF THE INVENTION

In accord with the invention several spaced disk elements are rectangularly mounted on an axial rotatable kneading shaft within a cylindrical casing, each disk carrying an axial kneading blade at its outer edge so as to scrape or be very close to the inner casing well as the disk rotates. Hook-like kneading counterelements fixed in the casing contain interconnected arms constructed and arranged to form a kneading gap for the kneading blades as well as to scrape and clean both the disks and the shaft as these stirring elements rotate. The scraper for each disk has at least two separate scraping edges which are at an angle to one another thereby to divide a mixed product into differently directed product flows. The arms of these kneading counterelements have both radially extending and axially inclined segments with correspondingly inclined surfaces adjacent to their scraping edges thereby to give the scraped product powerful radial and axial transport force components. This construction greatly improves product flow and reduces wear of the scraping edges.

In acoord with another aspect of the invention of the disk scraping edges is located to initially clean the product from the disk surface adjacent to the shaft while the other scraping edge is located to follow and scrape the remaining surface of the disk. The leading edge may also be subdivided in comb-like manner so that initially ring-shaped, separate product strips are scraped from the disk thereby further segmenting the product flow.

In accord with a further aspect of the invention at least two kneading counterelements are located between two adjacent axially displaced disk elements so that one counterelement scrapes the surface of one disk while the other counterelement scrapes the opposing surface of the other disk, thereby directing the product into a mixing region between the two disks.

Still further aspects and features of the invention will become apparent from the following detailed description.

BRIEF DESCRIPTION OF THE DRAWINGS

The invention is described in greater detail hereinafter relative to non-limitative embodiments and the attached drawings, wherein show.

DETAILED DESCRIPTION OF THE INVENTION

Figure 1:
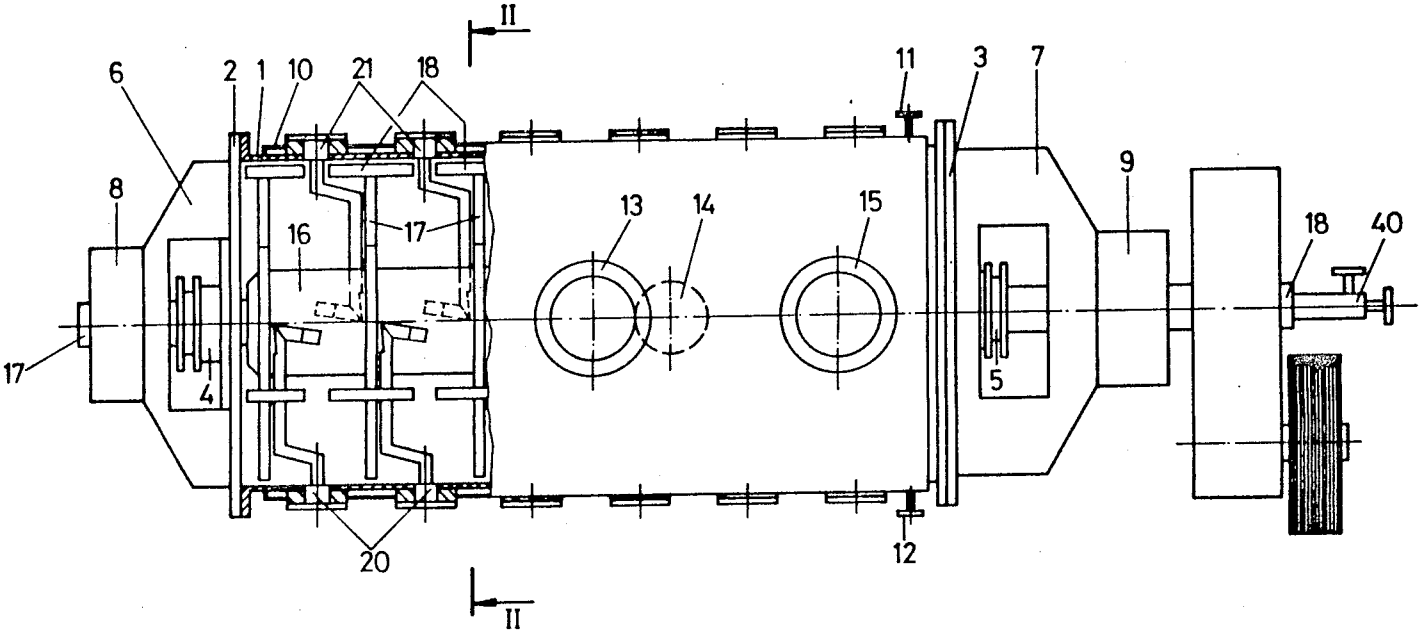
FIG. 1 A plan view of a kneader- mixer with rotary disks, partly sectioned in the longitudinal axis.
Figure 2:
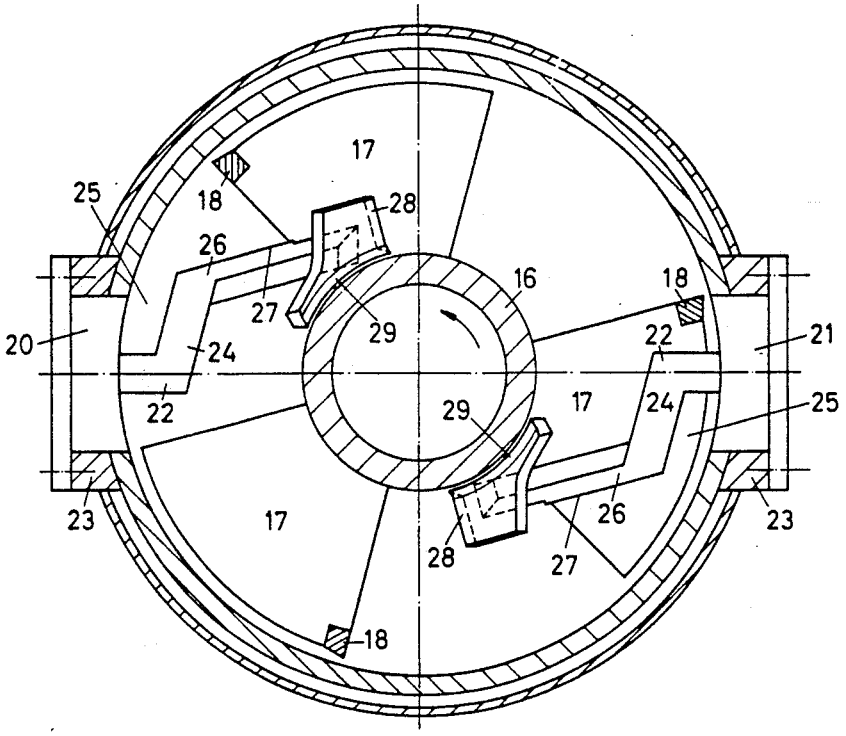
FIG. 2 A cross-section through the kneader-mixer according to FIG. 1 along line II—II thereof.
Figure 3:
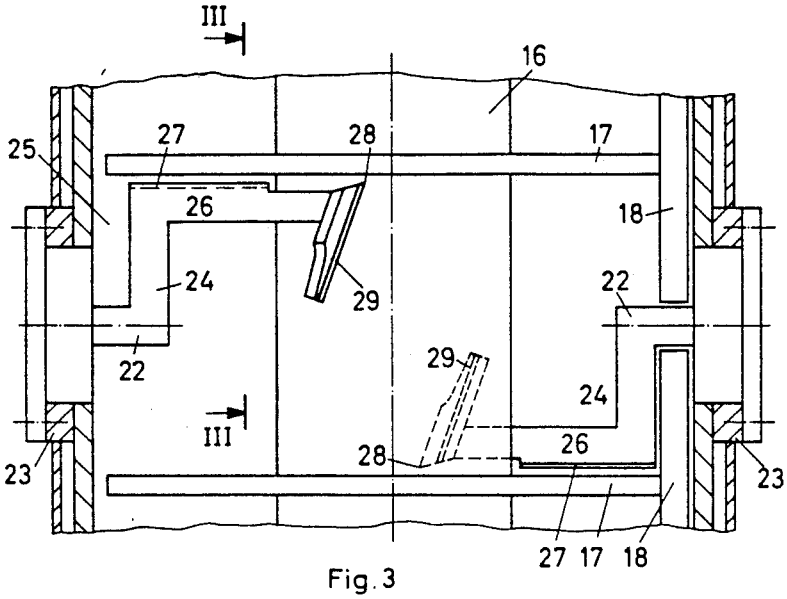
FIG. 3 Part of a longitudinal section relative to FIG. 2.

FIGS. 1 to 3 show a construction for batchwise operation. Part of the casing is cut open to make it easier to see the stirrer shaft.

On both sides the cylindrical casing I is provided with end covers 2,3 in which are fixed the stuffing boxes 4,5 and/or the cages 6,7 in which are arranged the stirrer shaft bearings 8,9. All casing parts are provided with the heating jacket 10. The connections for the heating system are designated 11 and 12. The casing is provided with filling connection 13, emptying connection 14, as well as gas draining or supply connections 15. Stirrer shaft 16 rotates in the cylindrical and mainly horizontal or slightly sloping casing and is supported in bearings 8,9 with the shaft journals **8*a*, 9*a*. The disk elements 17 are fixed to shaft 16 and on said elements are fixed the approximately axially parallel or slightly sloping kneading blades 18 on the outer diameter. Kneading blades 18 are very close to this inner wall of casing 1 so as to be able to scrape material from the wall upon rotation of the disk elements 17. The kneading counterelements 20,21** are fixed in the casing between in each case two stirrer disk planes.

As best shown in FIGS. 2 and 3, each kneading counterelement comprises a support collar 22 fixed in a flange 23 of the casing and three interconnected arm segments integrally attached to the end of collar 22, namely, a kneading arm 24, a radial scraper 26 and a shaft scraper 29. Kneading arm 24 is spaced from the casing wall and extends in a radially and axially inclined direction up to the disk surface. The predominant direction of arm 24 is axial and the spacing from the casing wall is chosen to provide a kneading gap 25 through which the kneading blade 18 moves to press the product onto the disk element 17.

The radial scraper 26 for cleaning the disk surface is supported on the end of kneading arm 24, and has two scraping edges 27 and 28 which are at an angle to one another. At its far end the radial scraper 26 also carries the shaft scraper 29 which extends in an inclined predominantly axial direction with its scraping edge pressing against shaft 16. Collar 22, kneading arm 24, radial scraper 26 and shaft scraper 29 thus form a hook-like kneading counterelement with radially and axially inclined segments.

In the represented embodiment, the disk scraping edge 28 also comprises the upper edge of shaft scraper 29 and leads into the shaft scraping edge of shaft scraper 29. Two kneading counterelements are supported from opposing sides of the casing between two axially adjacent disk elements and are arranged to scrape the opposing and facing surfaces of these two disks. The shaft scrapers 29 thus extend in opposite inclined axial directions and thereby also face each other in axially spaced relation.

During rotation of the stirring elements the scraping edge 28 initially cleans the inner part of the disk surface and the entrained scraped product is conveyed axially away from the disk surface and the entrained scraped product is conveyed axially away from the disk surface along the surface of inclined shaft scraper 29. The entrained product is thus given a powerful axial transport force component into the space between the disks. The scraping edge 27 follows edge 28 and cleans the remaining outer part of the disk surface. Both the kneading arm 24 and the radial segment comprising radial scraper 26 are inclined with respect to a longitudinal plane passing through the axis so that the product scraped by scraping edge 27 is conveyed in the region of arm 24 and scraper 26 away from the disk surface and into the space between the disks or into the kneading ga 25 under both radial and axial transport force components.

The working principle is based on the fact that the filled product is taken up by the disk surfaces 17 and the kneading blades 18 thereto and is conveyed against the kneading counterelements 21,22. The product scraped from the stirrer surfaces by the kneading counterelements is on the one hand conveyed against the facing disk surface, where it is mixed with the product entrained by it and on the other hand is pressed by the kneading blade 18 into the kneading gap 25, where it is exposed to high shearing forces.

The subdivision of the scraper into two scraping edges leads to the division of the product into two product flows, which are mixed together again between the disks. This leads to an improved mixing and kneading effect. This effect is made even more intense in that, due to its inclined position, the radial scraper arm 26 conveys more material into the kneading gap 25. Apart from this improvement of the mixing and kneading effect, the inclined position of the radial scraper 26 leads to very large passage surfaces of the product within the kneading counterelements and thereby avoids any build up of specific structurally viscous products on the kneading counterelements.

Figure 4:
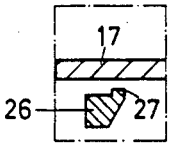
FIG. 4 A detail through the scraper arm for cleaning the disk surface along line III—III in FIG. 3.

The detail of FIG. 4 shows the cross-section of the radial scraper arm 26 with the scraping edge 27 and its position with respect to disk element 17.

Normally in each case two kneading counterelements are placed between two disk planes each of said elements cleans one of the facing disk surfaces, but more kneading counterelements can be provided. However, it must be borne in mind that the position of the kneading blades on the disk elements is so chosen with respect to the kneading counterelements, that a very uniform force requirement is ensured.

Figure 5:
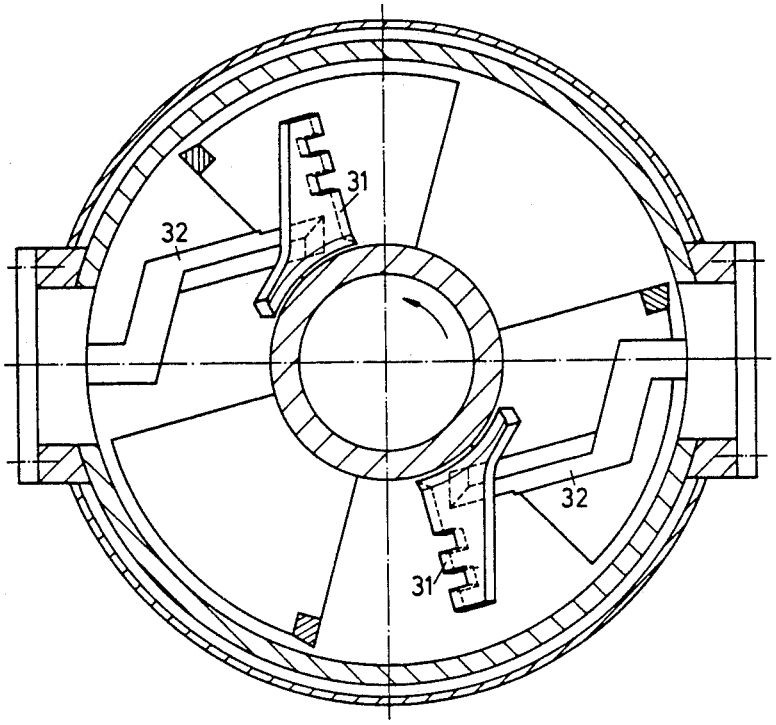
FIG. 5 A representation of a hook-like kneading counter element with a comb-like construction of the first scraping edge.

The scraping edges can also be subdivided in a different way. FIG. 5 shows an example in which the first scraping edge has a comb-like construction, so that initially strips are removed from the product surface, whilst the scraping edge 32 scrapes the remainder of the product still adhering to the disk surface in the form of rings.

Another simple possibility for subdividing the scraper arm is to initially only remove the upper part of the product layer with the first scraper and to remove the remaining product layer with the second scraper.

Figure 6:
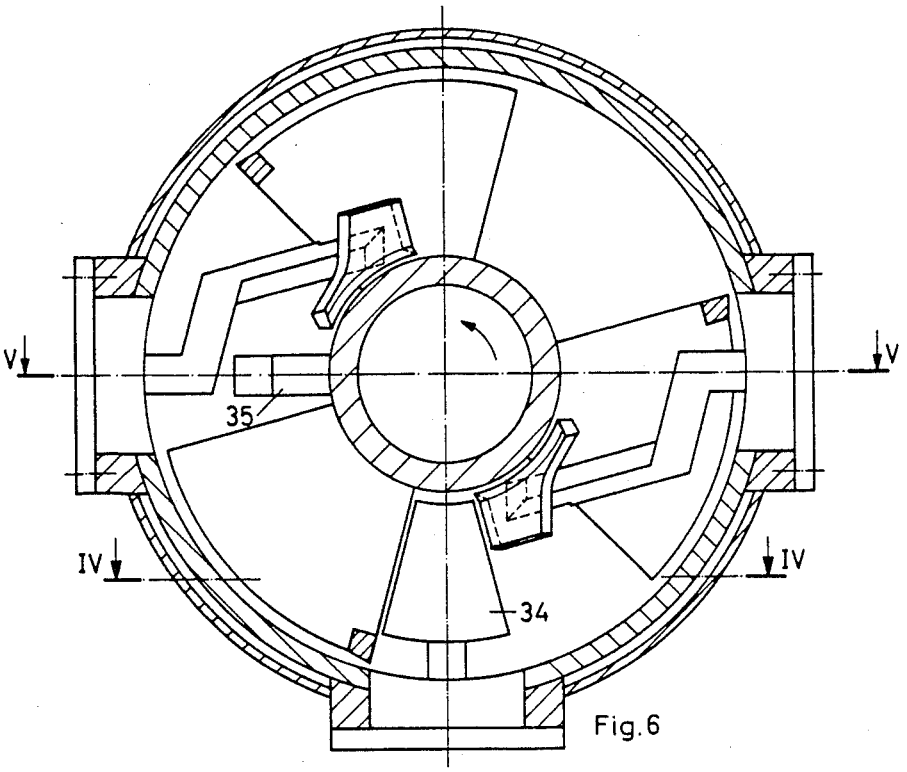
FIG. 6 A cross-section through a kneader-mixer according to FIG. 2, but with a wedge-shaped distributor for the product area on two opposite disk surfaces, as well as an additional kneading blade on the stirrer shaft.
Figure 7:
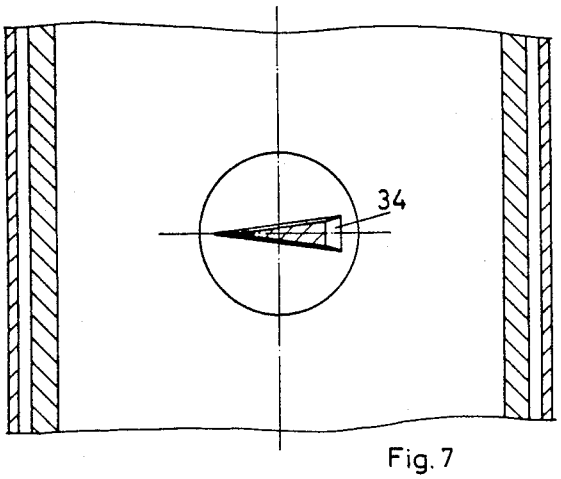
FIG. 7 Part of a longitudinal section along line IV—IV of FIG. 6.

FIGS. 6 and 7 show a distributor 34 which is fixed in the casing between two disk planes and which serves to distribute the product over the two facing disk surfaces. This can bring about a compression of the product which in the case of certain products makes the kneading activity of the kneading counterelements more intense.

Figure 8:
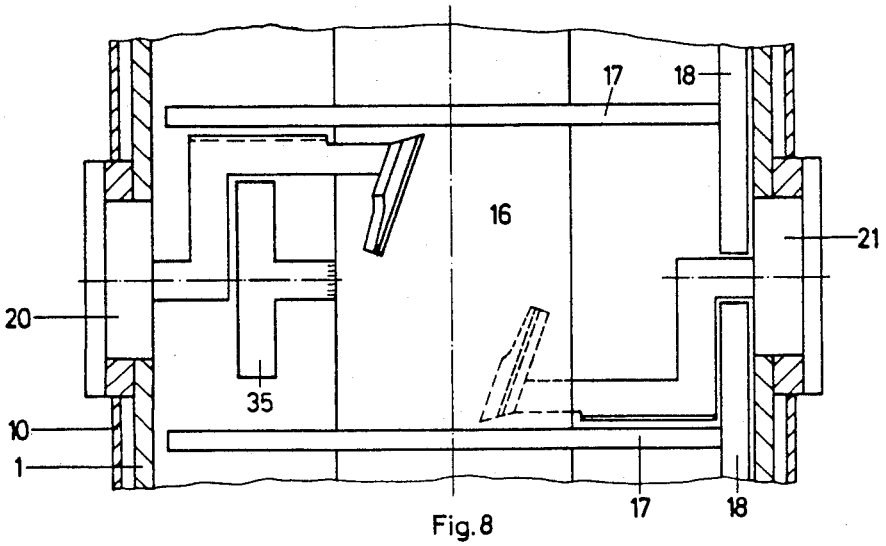
FIG. 8 Part of a longitudinal section along line V—V of FIG. 6.

FIGS. 6 and 8 show an approximately T-shaped stirring finger 35, attached to shaft 16, which can be used in order to make more intense the product movement in the cross-section between the disk surfaces not covered by the kneading counterelements. Apart from the aforementioned T-shape, the stirring fingers can also have some other appropriate construction.

Figure 9:
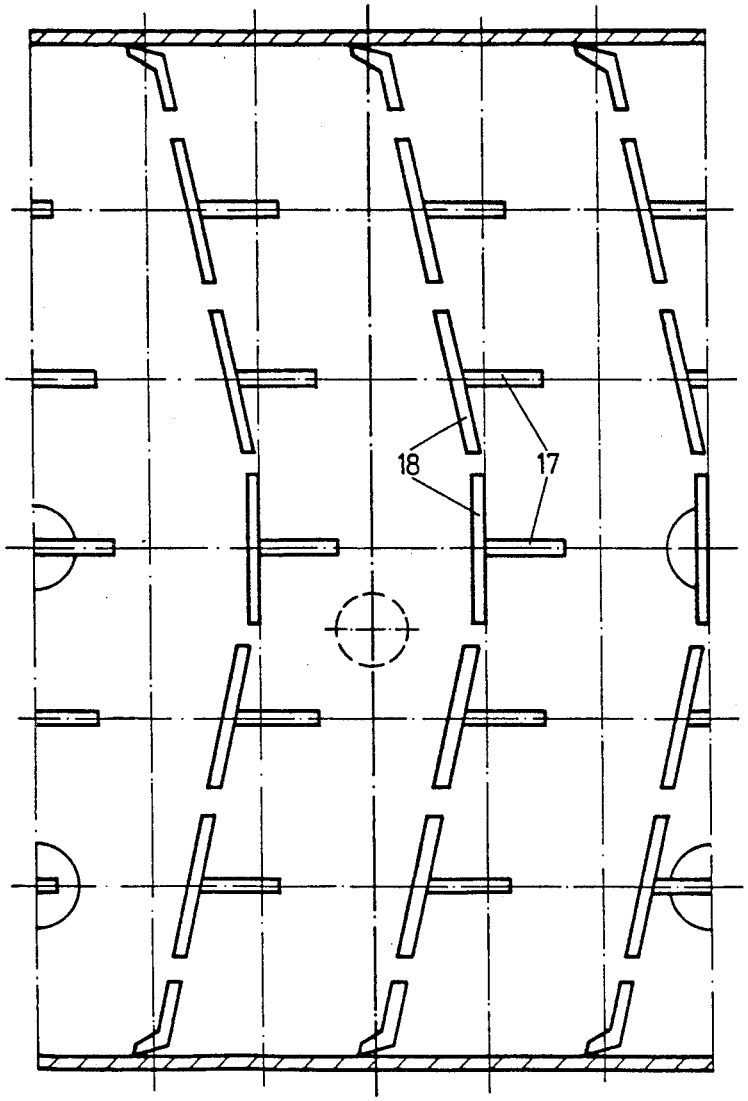
FIG. 9 A development for a kneader-mixer operating in batch-wise manner.

In a simple manner, the inventive principle also makes it possible to produce an axial product exchange in the kneader-mixer in that an axial transport of the product is ensured by an appropriate transverse displacement and inclination of the axially spaced kneading blades 18 fixed to disk 17. According to the embodiment of the cylindrical inner surface of a batch processing kneader-mixer shown in FIG. 9, as a result of the inclined position of kneading blades 18 on opposite sides of the central blades a conveying or transport action is exerted on the product that products entering from opposite sides are moved from the outside into the center of the machine where they can be exchanged and/or mixed.

Using the same principle of inclined kneading blades, in other machines a continuous passage of the product from inlet to outlet may be ensured by using kneading blades which all have the same slope. A flow-back from outlet to inlet can also be obtained through oppositely inclined kneading blades.

With respect to the performance of thermal processes, reference is also made to the possibility of obtaining very large heat transfer surfaces in all kneader-mixers. Normally not only are all the casing walls heatable, but also the shaft and disk elements of the stirrer. The heating or cooling agent is then supplied through the known mechanical slip ring heads to the shaft ends, as illustrated in FIG. 1 by part 40.

While specific embodiments of the invention have been described herein, it is intended by the appended claims to cover all further embodiments and modifications of the invention which fall within the broad scope and gist of the invention described.

We claim:

1. A kneader-mixer for treatment of products in a liquid, pasty or pulverulent state, comprising a cylindrical casing, a kneader shaft rotatably supported within said casing along an axis thereof, at least two disk elements normally fixed to said shaft in axially spaced relation to one another and rotatable together with said shaft, each disc element carrying at an outer edge thereof a kneading blade which axially extends adjacent to said casing, at least one kneading counterelement comprising a kneading arm segment and a disk scraping segment, said kneading are segment extending in a predominantly axial direction toward one of said disk elements in space relation to said casing to form a kneading gap through which the kneading blade of said one of said disk elements can pass, said disk scraping segment extending alongside said one of said disk elements in a predominantly radial direction and having first and second disk scraping edges which are at an angle relative to one another whereby different areas of said one of said disk elements are cleaned by each edge and a product is divided into two differently directed product flows.

2. The kneader-mixer of claim 1 wherein means are provided for heating said cylindrical casing, said kneader shaft and said disk elements.

3. The kneader-mixer of claim 1 wherein the first disk scraping edge is arranged to clean only (cleans) one layer of the product adhering to the said one of said disk elements and the second disk scraping edge is arranged to clean a remaining layer of the product.

4. The kneader-mixer of claim wherein the first disk scraping edge is arranged to clean the product from a disk surface adjacent to the shaft and the second disk scraping edge is arranged to thereafter clean an outer surface of said one of said disk elements.

5. The kneader-mixer of claim 3 wherein the first disk scraping edge is subdivided in a comb-like manner whereby ring-shaped product strips are initially scraped from a disk surface.

6. The kneader-mixer of claim 1 wherein the kneading arm segment and the disk scraping segment of the kneading counterelement are both inclined with respect to planes passing through an axis of shaft rotation whereby a product scraped from (the) said one of said disk element by the disk scraping segment is given axial transport force components by said prdominantly radially extending disk scraping segment.

7. The kneader-mixer of claim 1, wherein said at least one kneading counterelement also comprises a shaft scraper attached to said disk scraper segment and engaging said shaft, said shaft scraper extending in an inclined predominantly axial direction with respect to said first disk scraping edge whereby a product scraped by said first edge is given an axial transport force component by said shaft scraper.

8. The kneader-mixer of claim 7 wherein a second kneading counterelement also having a shaft scraper is fixed to said casing opposite said one kneading counterelement between said two disk elements, each counterelement extending toward and scraping an opposing surface of a different one of said disk elements, (both) said shaft scrapers of said one kneading counterelement and said second kneading counterelement being similarly inclined so as to generally face one another whereby products scraped from said opposing disk surfaces are given axial transport force components to pass into the region between the two disk elements.

9. The kneader-mixer of claim 7 wherein a second kneading counterelement is fixed to said casing opposite said one kneading counterelement between said two disk elements, each counterelement extending toward and scraping an opposing surface of a different one of said disk elements.

10. The kneader-mixer of claim 9 wherein a wedge shaped distributing element is fixed to the casing between said one and second kneading counterelements in the region between the two disk elements to help distribute a product flow derived from the two opposing disk surfaces.

11. The kneader-mixer of claim 9 wherein said second kneading counterelement also has a shaft scraper and a kneading arm segment and wherein a T-shaped kneading element is fixed to the kneader shaft with a head of the T arranged to pass between the kneading arm segments and the shaft scrapers of said one and second kneading counterelements upon rotation of the kneader shaft.

12. The kneader-mixer of claim 1, wherein a plurality of disk elements are axially spaced on the kneader shaft with each disk element carrying at least one kneading blade, and several of said blades are generally similarly inclined with respect to axial planes thereby to provide a transport force component to a mixed product in a desired axial direction.

* * * * *